United States Patent [19]

Winters

[11] 4,339,057

[45] Jul. 13, 1982

[54] FILTER PAPER DISPENSER

[76] Inventor: David L. Winters, 13677 Brainbridge, Warren, Mich. 48089

[21] Appl. No.: 25,342

[22] Filed: Mar. 30, 1979

Related U.S. Application Data

[63] Continuation of Ser. No. 845,594, Oct. 26, 1977, abandoned, which is a continuation of Ser. No. 696,204, Jun. 15, 1976, abandoned.

[51] Int. Cl.[3] ..... B65H 1/06; B65H 3/22

[52] U.S. Cl. ..... 221/213; 221/231

[58] Field of Search ..... 221/213, 214, 216, 231; 271/18.3

[56] References Cited

U.S. PATENT DOCUMENTS

| | | | |
|---|---|---|---|
| 410,045 | 8/1889 | Tabour | 221/213 X |
| 859,853 | 7/1907 | Stewart | 221/216 X |
| 1,074,696 | 10/1913 | Cooley | 221/40 |

*Primary Examiner*—Joseph J. Rolla
*Assistant Examiner*—Frederick R. Handren
*Attorney, Agent, or Firm*—William L. Fisher

[57] ABSTRACT

A dispensing device is disclosed for dispensing nested dished papers. The device has a base for holding a stack of nested dished papers. The dishing of the papers is such that each paper has a bottom wall and a substantially conical side wall. The device includes a paper sticking member mounted on the base adjacent to the stack of nested dished papers. The stack of nested dished papers and the paper sticking member are moved relative to each other so that the conical side wall of the adjacent paper of the stack of nested dished papers is stuck with the paper sticking member. The conical side wall and continued relative movement of the paper sticking member are used for pulling the paper from the stack of nested dished papers and dispensing the same.

8 Claims, 2 Drawing Figures

FILTER PAPER DISPENSER

This application is a continuation of application Ser. No. 845,594 filed Oct. 26, 1977, now abandoned which is a continuation of application Ser. No. 696,204 filed June 15, 1976, now abandoned.

My invention relates to dispensing nested dished papers, such as filter papers, particularly filter papers for coffee.

The principal object of my invention is to provide a filter paper dispenser particularly for filter papers presently used in automatic coffee-making machines which facilitates the removal one at a time of filter papers from the stack of filter papers.

Figure 1:
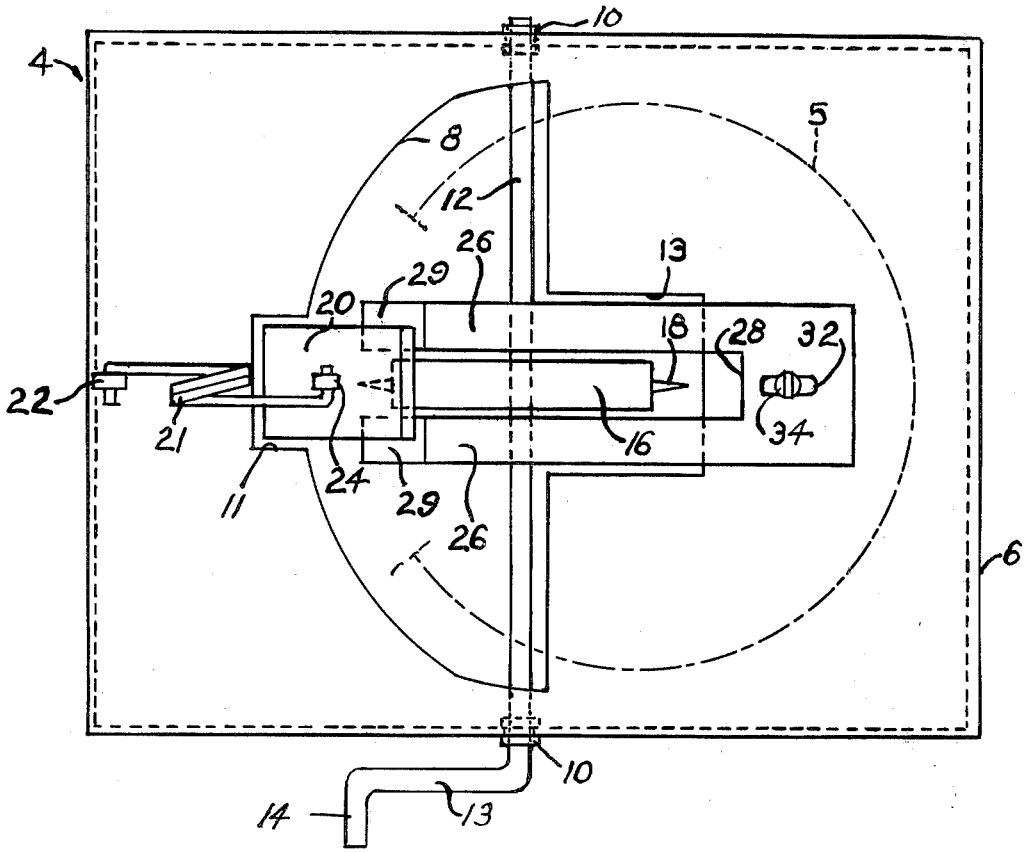
Figure 2:
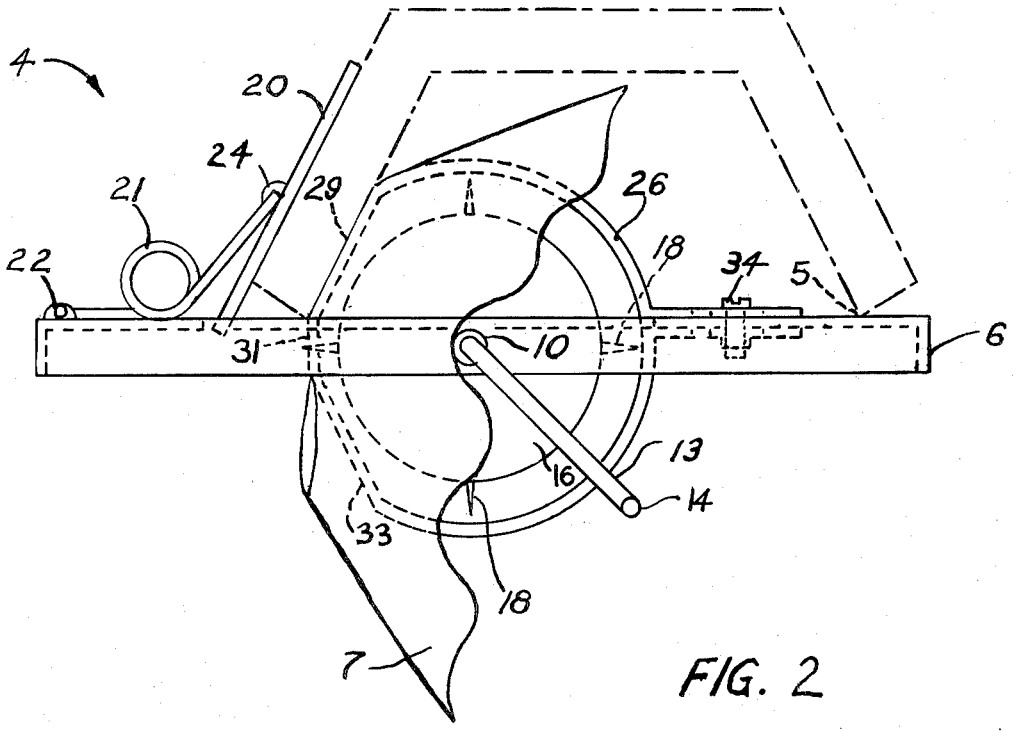

The foregoing object of my invention and the advantages thereof will become apparent during the course of the following description, taken in conjunction with the accompanying drawings, in which:

FIGS. 1 and 2 are, respectively, top plan and side elevational views of a filter paper dispensing device embodying my invention.

Referring to the drawings in greater detail, 4 generally designates said dispensing device which includes a base 6 having vertical walls and a horizontal floor for supporting a stack 5 of filter papers for an automatic coffee-making machine. Said stack 5 consists of nested dished filter papers supported on said floor in an inverted position as shown. The dishing of said nested papers is such that each has a bottom wall and a substantially conical side wall; i.e., one which is frusto-conical in vertical cross-section or substantially so. Said floor is provided with apertures 8 and 13 therein. Said aperture 8 is substantially semi-circular in shape and large enough to pass a filter paper therethrough. In FIGS. 1 and 2 the stack 5 is shown in broken lines while the dispensed filter paper in the process of passing through said aperture 8 is shown in solid lines and designated by the reference numeral 7. Said stack 5 is shown in FIG. 1 by a circle which is left incomplete for purposes of clarity of illustrating the operative parts of said device 4. Said base 6 is adapted and intended to be supported on suitable stationary structure such as a wall or even a counter if sufficiently elevated. A pinwheel 16 having pins 18 thereon protruding from the circumference thereof is made fast to an axle 12 suitably affixed to said base 6 and rotatably supported by grommets 10 which serve as bearings for said axle 12. A crank 13 and handle 14 are provided at one end of the axle 12 for rotating said pinwheel 16. Said pinwheel 16 is arranged to rotate in said apertures 8 and 13 and extends above and below the floor of said base 6. A bifurcated member 26 formed into a large loop to surround said pinwheel 16 is fastened to the floor of said base 6 by suitable fastener means 34 which extends through slots 32 in the ends of said member 26. Said slots 32 allow the loop of said member 26 to be adjustably positioned radially in respect to said pinwheel 16 for purposes which will appear. Said pinwheel 16 rotates in the slot formed by the bifurcated sections of said member 26 and the pins 18 thereon project radially beyond the loop of said member 26. The loop of said member 26 has flats 29, 31, and 33 formed thereon for purposes which will appear. In surrounding the pinwheel 16, said member 26 protects a user's fingers from striking the pins 18 and said flats 29 thereon serve as a stop for said stack 5. Said stack 5 is positioned on said floor so that the pinwheel 16 and member 26 are inside thereof, whereby upon rotation of said pinwheel 16 the pins 18 will stick a substantially conical wall of the bottommost one of the filter papers of said stack 5. By being adjustably positionable in respect to the pinwheel 16 said member 26 also determines how far beyond said flats 29 the pins 18 can project and hence the extent to which the pins 18 can stick into said conical wall of the bottommost filter paper. The stack 5 is yieldably pushed inwardly against said flats 29 by a moveable board 20, the front side of which bears against the outside of the stack 5. The board 20 is actuated by a coil spring 21 which has its opposite ends suitably fastened, respectively, to the floor of said base, as at 22, and to the back side of said board 20, as at 24. The lower end of said board 20 moves in the aperture 11 beneath the floor of said base 6. Said member 26, by said flats 31 and 33 thereon, also serves to guide the dispensed filter paper 7 in its movement from said stack 5 after it has been stuck via said conical wall thereof by one or more of said pins 18. The stack 5 of inner papers may be enclosed in a preferably transparent cover fitted over the base 6, if desired.

In operation of said dispensing device 4, a stack 5 of filter papers is placed in an inverted position on said floor and the board 20 is arranged to bear against the outside of said stack 5 as shown. The handle 14 is rotated by the user of said dispensing device 4, whereupon one or more pins 1 stick into the bottommost filter paper and pull it via the stuck conical thereof downwardly from the stack 5 and move it via the stuck conical wall thereof through said aperture 8 and beneath the flats 33 where it is dispensed (as shown and indicated at 7 in FIG. 2) via the stuck conical wall thereof and easily reached by said user. The board 20 yieldably maintains the stack 5 biased against the flats 29 so that a subsequent bottommost filter paper is ready to be dispensed when needed. Before the supply of filter papers is completely depleted it is preferable to load the dispensing device 4 with a fresh stack 5 of filter papers so that the pins 18 are always picking said conical wall of the bottommost filter paper from a stack 5 thereof.

It will thus be seen that there has been provided by my invention a dispensing device for nested dished filter papers in which the object hereinabove set forth, together with many thoroughly practical advantages, has been successfully achieved. While a preferred embodiment of my invention has been shown and described, it is to be understood that variations and changes may be resorted to without departing from the spirit of my invention as defined by the appended claims.

What I claim is:

1. A dispensing device for dispensing nested dished papers comprising means including a base for holding a stack of nested dished papers, said base having an opening therethrough, the dishing of said papers being such that each paper has a bottom wall and a substantially conical side wall, a paper sticking member movably mounted on said base adjacent said opening, means disposing said stack on said base so that said paper sticking member is positioned within the nearest paper of said stack of nested dished papers, means relatively moving said stack of nested dished papers and said paper sticking member so that the conical side wall of said nearest paper of said stack of nested dished papers through said opening is stuck with said paper sticking member, and means using the conical side wall and continued relative movement of said paper sticking member for pulling said paper from said stack of nested dished papers and dispensing the same.

2. A method of dispensing nested dished papers from a stack by means of a paper sticking member, the dishing of said papers being such that each paper has a bottom wall and a substantially conical side wall, said method comprising: supporting said stack on a base having an opening therethrough, movably mounting said paper sticking member on said base adjacent said opening, disposing said stack on said base so that said paper sticking member is positioned within the nearest paper of said stack of nested dished papers, relatively moving the stack of nested dished papers and the paper sticking member together so that the conical side wall of the nearest paper of the stack of nested dished papers is stuck with said paper sticking member, using the conical side wall and continued relative movement of said paper through said opening sticking member for pulling said paper from the stack of nested dished papers and dispensing the same.

3. A dispensing device for dispensing nested dished papers comprising means including a base for holding a stack of nested dished papers, means holding said stack of nested dished papers in an inverted position on said base, a pinwheel, means rotatably mounting said pinwheel on said base, said pinwheel having a plurality of pins thereon, means disposing said pinwheel inside of the inverted stack of nested dished papers and yieldable means relatively yieldably moving said stack of nested dished papers and said pinwheel toward each other while said pinwheel is rotating so as to stick the innermost paper of said stack with one or more pins on said pinwheel, means providing an arcuate dispensing aperture in said base, and means using the continued rotation of said pinwheel for pulling said innermost paper from said stack so as to dispense the same out of said aperture to the user of said device.

4. A dispensing device as claimed in claim 3, a guard for said pinwheel, said guard serving as a guide for said innermost paper in its movement from said stack.

5. A dispensing device as claimed in claim 3, further including means for controlling the extent to which said innermost paper gets stuck by one or more pins on said pinwheel.

6. A method of dispensing nested dished papers comprising using a rotatable pinwheel having a plurality of pins thereon, utilizing a stack consisting of inverted nested dished papers, disposing said pinwheel inside of the inverted stack, and relatively yieldably moving said stack and said pinwheel toward each other while said pinwheel is rotating so that the innermost paper of said stack is stuck with one or more pins on said pinwheel, providing an arcuate dispensing aperture adjacent said pinwheel, and pulling said innermost paper from said stack by the continued rotation of said pinwheel so as to dispense the same out of said aperture to the user of said device.

7. A method as claimed in claim 6, guarding said pinwheel and guiding said paper in its movement from said stack, said guiding being accomplished by said guarding.

8. A method as claimed in claim 7, further comprising controlling the extent to which said innermost paper gets stuck by one or more pins on said pinwheel.

* * * * *